United States Patent [19]

Kunz

[11] Patent Number: 4,649,980

[45] Date of Patent: Mar. 17, 1987

[54] ROLLER-BLIND SUITABLE FOR USE WITH A HOLLOW INSULATED PANEL, AND A DOUBLE PANE INSULATED PANEL WITH A MOVABLE BLIND THEREIN

[76] Inventor: Kurt Kunz, Hauptstr. 89, 8255 Schlattingen, Switzerland

[21] Appl. No.: 703,327

[22] Filed: Feb. 20, 1985

[30] Foreign Application Priority Data

Feb. 27, 1984 [CH] Switzerland ..... 934/84

[51] Int. Cl.[4] ..... E06B 3/32

[52] U.S. Cl. ..... 160/98; 160/26; 160/310

[58] Field of Search ..... 160/98, 25, 107, 99, 160/100, 26, 310

[56] References Cited

U.S. PATENT DOCUMENTS

| | | | |
|---|---|---|---|
| 2,530,218 | 11/1950 | Barrows | 160/98 |
| 2,658,570 | 11/1953 | Engel . | |
| 2,854,102 | 9/1958 | Peeples | 160/107 X |
| 3,022,549 | 2/1962 | Cummings | 160/107 |
| 3,253,644 | 5/1966 | Gotoh et al. . | |
| 4,072,404 | 2/1978 | Brown | 160/310 X |
| 4,076,068 | 2/1978 | Archer et al. | 160/107 |
| 4,096,903 | 6/1978 | Ringle | 160/107 X |
| 4,197,896 | 4/1980 | Reichstadt | 160/107 |
| 4,234,032 | 11/1980 | Stark | 160/26 |
| 4,338,996 | 7/1982 | Frank | 160/26 X |
| 4,407,349 | 10/1983 | Ekstrom | 160/98 |
| 4,508,154 | 4/1985 | Wheeler | 160/98 |

FOREIGN PATENT DOCUMENTS

| | | | |
|---|---|---|---|
| 889129 | 12/1971 | Canada | 160/107 |
| 2314013 | 10/1973 | Fed. Rep. of Germany | 160/107 |
| 2921608 | 12/1980 | Fed. Rep. of Germany . | |
| 2935982 | 4/1981 | Fed. Rep. of Germany . | |
| 2520431 | 7/1983 | France | 160/26 |

*Primary Examiner*—Ramon S. Britts
*Assistant Examiner*—David M. Purol
*Attorney, Agent, or Firm*—Ostrolenk, Faber, Gerb & Soffen

[57] ABSTRACT

A roller-blind which is suitable for combination with an insulated, hollow, transparent panel. The roller-blind is located in a housing having an opening on one longitudinal side. The opening of the housing is defined by longitudinal strips which rests upon and engage the opening of the hollow panel. The opening is shaped to mate, in an airtight manner, with the corresponding opening in the transparent hollow panel. In the housing, there is a roller which is mounted on two lateral closure walls located at laterally opposite sides of the housing. A motor is provided for turing the roller. Rotation of the roller permits the blind to move into and out of the panel. Because the motor is electrically actuated and exterior rotatable shafts are not used, the airtightness of the interior of the panel is very reliable. The roller-blind insulated panel combination is practical in use, is economically manufacturable, and can be constructed as a prefabricated unit for standard window or door frames.

27 Claims, 12 Drawing Figures

ROLLER-BLIND SUITABLE FOR USE WITH A HOLLOW INSULATED PANEL, AND A DOUBLE PANE INSULATED PANEL WITH A MOVABLE BLIND THEREIN

BACKGROUND OF THE INVENTION

The present invention relates to a roller-blind which is suitable for use in conjunction with a hollow, transparent insulated panel. The roller-blind includes a roller which is built into a housing which is open on its longitudinal side. The roller is driven by an electric motor arranged within the housing and a curtain or blind which can be wound and unwound is provided on the roller. The roller-blind and insulated panel are joined to permit the blind to move up and down within the insulated panel. Furthemore, the invention relates to the combination of the hollow transparent, insulated panel with the roller-blind.

Various types of insulated transparent window or door panes are known. Typically, two or more panes are bonded or pressed together so that the inside of the unit becomes air-tight.

Roller-blinds are furthermore known which include a curtain comprising reflective material, for example, a material or foil which can provide protection against the sun. The properties of such or similar foils for heat insulation are well known. Foils which are transparent to the spectral range of the sun's rays but which have very low emissivity are also known. In prior art devices, such foils are clamped rigidly between the panes.

Prior are devices have various drawbacks. Thus, for instance, foils containing reflecting materials behind the panes frequently cause condensation of water on the glass. Permanent protection devices are certainly highly effective in certain situations but they may produce a detrimental effects under some weather conditions.

The prior art also teaches insulated panels in which one or more roller-blind devices are arranged in the spaces between the panes. These known panels must, by definition, be tightly sealed off to prevent outside fluid from entering therein. To date, however, the production of operational insulated panels with movable blinds therein has not been successfully demonstrated. No structural proposals which teach a practical solution are known (Federal Republic of Germany No. OS 27 49 418).

U.S. Pat. No. 3,253,644 discloses a double insulated panel with an interior completely closed off from the outside and an attached foldable slats blind in the interior which can be brought together or pulled apart from the outside by means of magnets. Because actuation is from the outside by means of magnets, if resistance develops in the movement mechanism of the slat blind, it can no longer be moved from its stuck position. Furthermore, the construction shown for the insulated panel is not optimally designed for the installation of roller-blinds, in the sense that it cannot be produced a priori as a prefabricated unit in the factory.

German patent document No. OS 29 35 982 shows a multipane insulated panel with a housing for supporting a roller-blind device. The housing is of rectangular cross section, open on one side and located at the upper closure of the double insulated panel. In this case the drive of the roller-blind or roller and the curtain which can be wound onto and off of it is actuatable from the outside, requiring introduction of the actuating shaft from the outside into the inside of the housing in an air tight manner. This design, provides a poor sealed connection at best between the roller-blind housing and the double insulated panel. Additionally, the connection is subject to malfunction over time since the air seal which is perhaps initially effective becomes worn by the movement of the drive shaft and thus only temporary air tightness between the window panes and the roller-blind housing is possible. The danger of penetration of moist air and condensation on the inside of the panes of glass as well as of dust and the like is therefore present with this design.

Another insulated panel construction of the screening off of light is known from German patent document No. OS 2 314 013, in which a roller-blind device is installed between two panes of a double insulated panel window. This construction has a space between the two window panes which makes it possible to place the entire roller-blind in wound condition between the panes. It has been found in practice, however, that such large spacings between the panes are undesirable since they result in considerable difficulties, particularly with regard to stability. Therefore, the most effective insulated panel windows provide for a spacing on the order of 12 to 15 mm, a space which is insufficient for installing a roller-blind therein.

SUMMARY OF THE INVENTION

The object of the present invention is, therefore, to provide a roller-blind device which can be installed in an insulated panel and which is easily manufacturable. Further, it is an object of the invention to provide an insulated panel with a movable blind therein which can be used effortlessly. The panel should be usable for installment into existing window or door frames.

The foregoing and other objects of the invention are realized by a roller-blind which is suitable for installation in an insulated, transparent, panel. The roller-blind includes a roller-blind housing which is open on one longitudinal side thereof, and a roller which is driven by an electric motor and is arranged within the housing. A curtain or a blind capable of being wound or unwound from the roller through activation of the electric motor is also provided. The roller is mounted between and supported on two lateral closure walls which are inserted, in an air tight manner, in the housing. The housing is located generally above the insulated glass panel and includes a longitudinal strip which penetrates between the panes of the insulated panel to support and seal the housing and the panes of the insulated panel to one another in an air tight manner. Alternatively, the housing may include two longitudinal strips which extend into the insulated panel, each of the longitudinal strips engaging in an air tight manner one of the panes of the insulated panel. The longitudinal strips provide the necessary support for the housing.

Other features and advantages of the invention will now become apparent from the following description of the preferred embodiments of the invention which are described with reference to the following drawings.

DETAILED DESCRIPTION OF THE PREFERRED EMBODIMENTS

Figure 1:
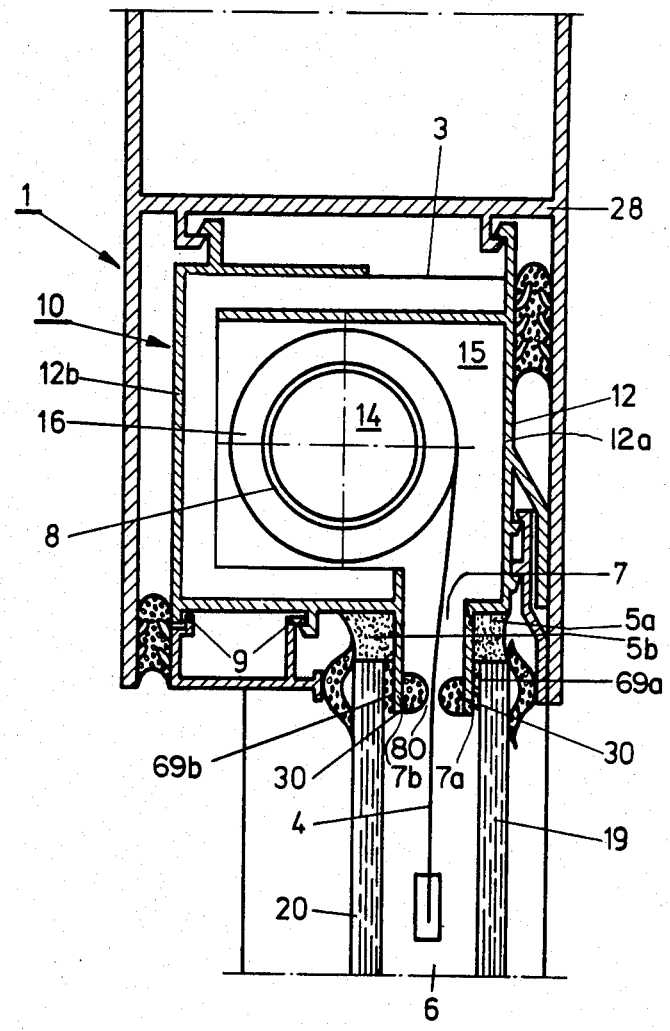
FIG. 1 is a cross section through the upper part of an insulated panel glazing window with a roller-blind unit installed in the insulated panel.
Figure 6:
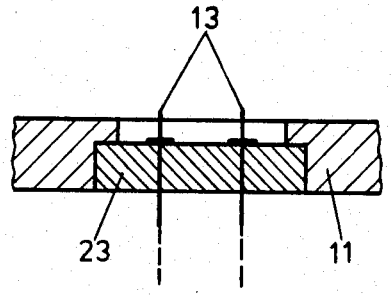
FIG. 6 is a section through a portion of a housing which shows the feed point for the feed line for the drive motor of the roller-blind.

FIG. 1 illustrates the upper part of a window 1 with an insulated panel located within a window frame profile 28, which can consist of two parts. It is, of course, possible, as shown in FIG. 1, to seal the entire unit as a fixed frame, i.e. self-contained and not disassemblable, or to seal the frame. The window 1 has an outer glass pane 19 and an inner glass pane 20. These panes of glass 19 and 20 serve as main surfaces which define a space 15 which is airtight and the upper closure of which is formed by a roller-blind device 10 having a roller-blind 8. The roller-blind 8 serves to receive a foil, for instance an embossed foil 4. The roller-blind 8 is surrounded by an airtight housing including piece 12*a* and 12*b*, for instance a metal housing. This housing is constructed in its upper, outer and lower inner regions to have a glass holding profile 7 comprised of first and second strips 7*a* and 7*b* which mates with the panes of glass 19 and 20 and the corresponding seals 5*a* and 5*b*. The inside of the housing 12 is lined with thermal and acoustic insulation 3. An electric drive motor 14, arranged in the manner shown in FIG. 7 within the roller-blind 8, is supplied with current by means of a feed line 13. As shown in the detail view of FIG. 6, this feed line 13 can be introduced hermetically into the space 15 by means of a through-hole plated printed board 23. However, it is also possible, to seal the feed line 13, for instance in butyl rubber. Electronics for driving the motor may include a pulse counter and pulse generating circuits. The electronics may be used to sense the end of travel of the motor in one of the other direction and/or for driving the motor.

Figure 8:
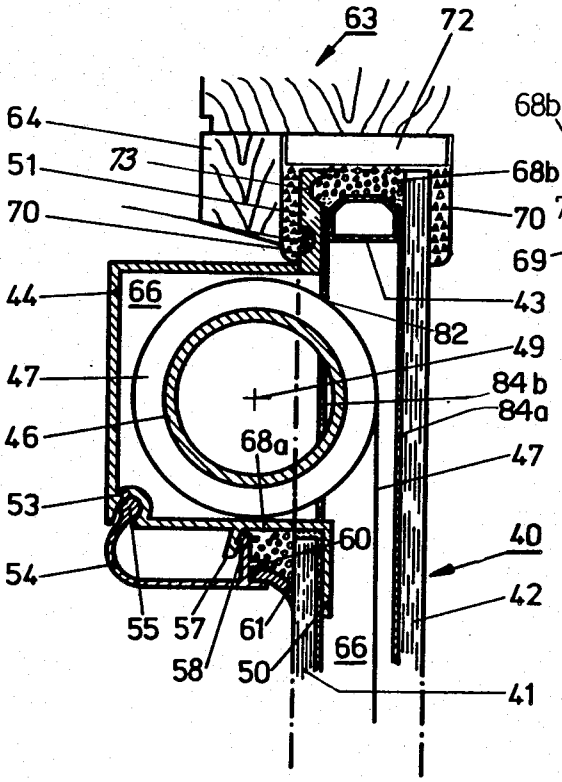
FIG. 8 shows a main embodiment of a double insulated panel installed in a given window frame or door frame.

The foil 4 can be guided in lateral guide rails which may be supplemented by a bottom guide rail. These rails can, for instance, be filled with silica gel in order to remove moisture from the space 15 which is closed in an airtight manner and to prevent any precipitation of condensate on the inner surfaces of the panes of glass 19 and 20. The panes of glass and the entire roller-blind device 10 are connected with each other in an airtight manner via the insulation seals 5*a*; 5*b* and 69*a*; 69*b*. This assembly is connected via the glass holding profile 7 to the window frame 28 so as to form a single unit. The glass holding profile 7 is in the form of first and second strips, denoted by numerals 7*a* and 7*b* in FIG. 1, which are located between the panes 19 and 20, or they may have the shape of the strips 50 and 51 as shown in FIG. 8, when the housing 44 is installed laterally with respect to the insulated panel.

The window with an insulated panel installed therein prevents when the foil 4 is lowered, an exchange of radiation between the inner and outer windows. The distance between the panes 19 and 20 is generally on the order of 12 to 15 mm. The spacing is important because larger spacings produce considerable difficulties. The roller-blind device 10 must therefore be constructed in such a way that the distances between the panes need not be enlarged to accommodate the blind. The volume between panes 19 and 20 defines an airtight inner space which is accessible only through a longitudinally extending opening denoted in FIG. 1 by reference number 80 and in FIG. 8 by numeral 82.

In accordance with the embodiment shown in FIG. 1, the two panes of glass 19 and 20 are shortened, along the height thereof, by the size of the roller-blind housing 12.

The shape of the housing, made for instance from aluminum sheet or fiberglass-reinforced plastic or the like, is so selected that the panes 19, 20, while maintaining their distance apart can rest, upon the placing of the housing against the strips 7*a* and 7*b*, on a sealing layer of the seals 5*a* and 5*b*, which comprise for instance, butyl. At the same time, corresponding mating surfaces of the housing 12 permit the latter to be sealed off from the panes of glass, for instance by means of strips 7*a* and 7*b* and seals 5*a* and 5*b*. The roller-blind housing 12, as can be noted, is connected firmly by clip elements to the window frame 28.

Figure 2:
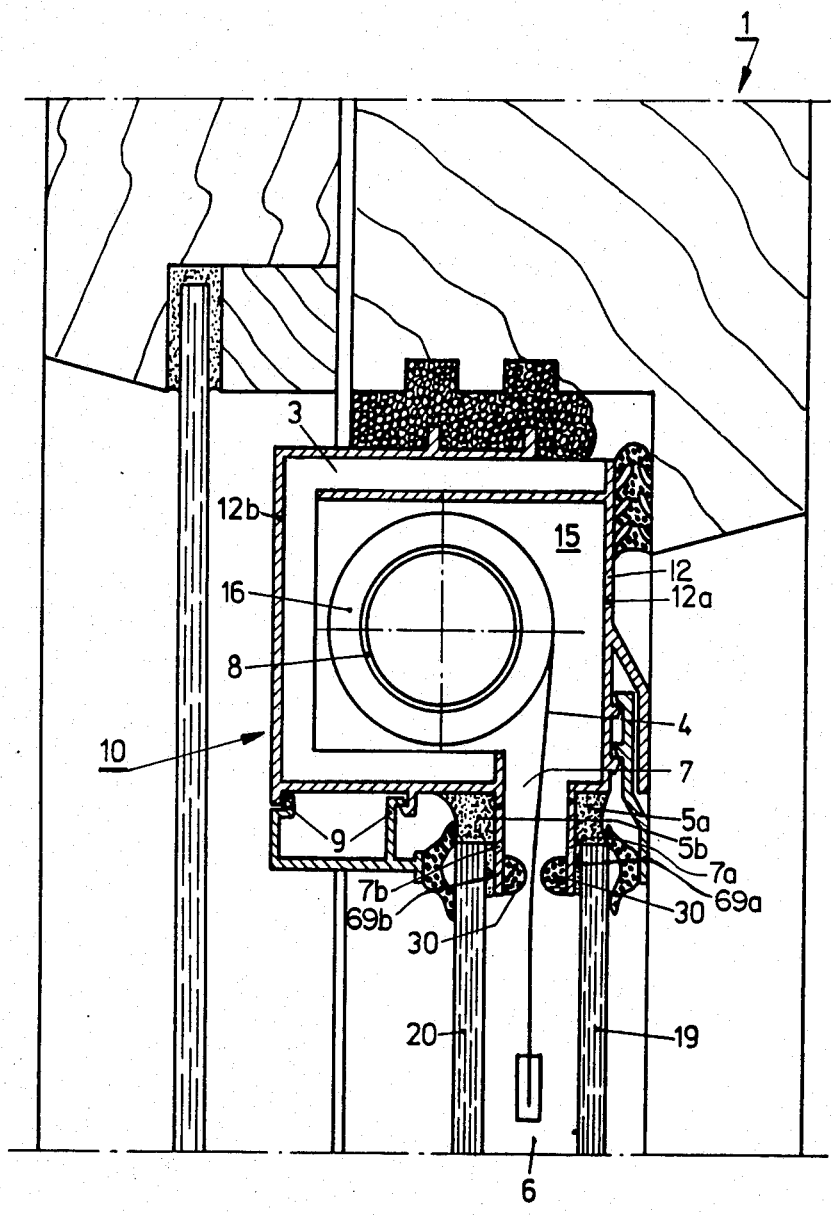
FIG. 2 is a variation of the roller-blind device and the fixtures thereof in the insulated panel shown in FIG. 1.

FIG. 2 shows a variant embodiment with the following features:

Two of the three panes of glass extend only to the bottom of the roller-blind housing 12. The roller-blind housing 12 serves as support and spacer for the panes of glass 19 and 20.

The entire roller-blind device is inserted in spigot-like manner onto the panes of glass 19 and 20, in the same way as a cork in a bottle.

Figure 3:
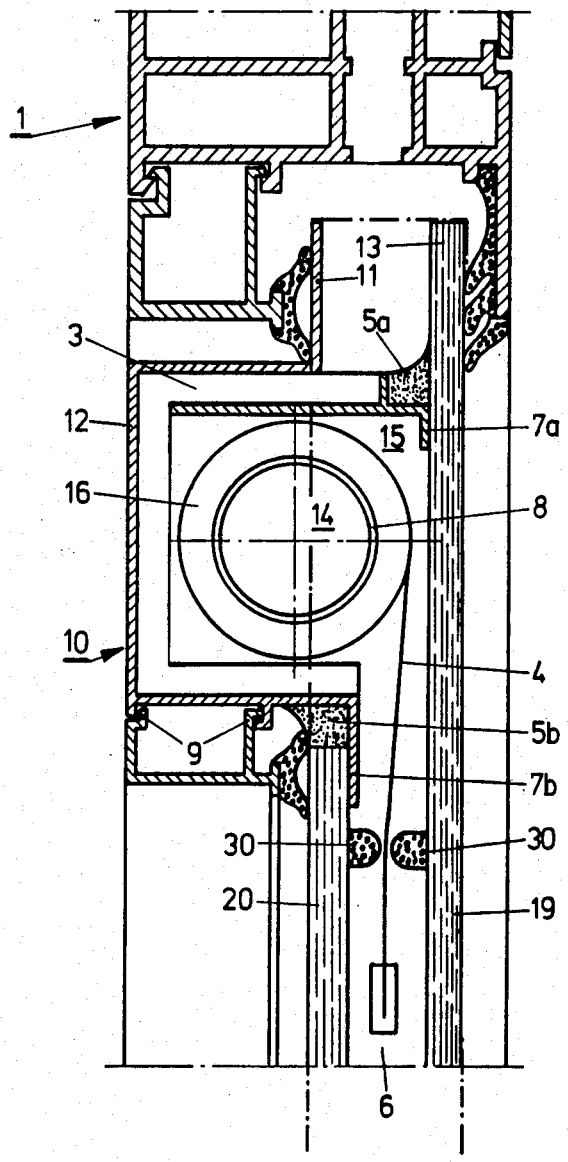
FIG. 3 shows another embodiment similar to FIG. 1.

The embodiment shown in FIG. 3 provides an additional conceptual variation over the embodiments of FIGS. 1 and 2. The roller-blind device 10 is constructed by shaping its upper closure strip 11 of the housing 12 to form the upper closure of the insulated panel structural unit. This is made possible because it has the outer dimensions, indicated in dash line, of an insulated panel without roller-blind device 10 therein—at least in its upper end regions. Therefore, the assembly according to FIG. 3 can be inserted, into given or existing window frames 1 in the same manner as devices which lock a roller-blind.

Furthermore, in FIG. 3, the outer pane of glass 19 has an extended end 13 or an inner glass pane 20 which is shortened so as to enable insertion of the roller-blind device 10 in the manner described as an upper closure into the insulated panel assembly. The unit is held fast in the window frame, as shown, by the holding and sealing elements, in which connection window rabbet strips 6 which form part of the window are preferably used.

Figure 4:
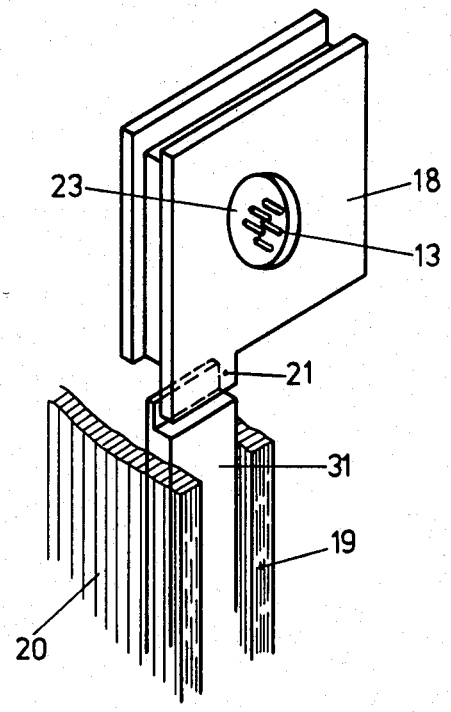
FIGS. 4 and 5 show, in perspective, details of installation.

FIG. 4 shows, in perspective, the upper part of a glass window having two panes 19 and 20, with a roller-blind unit placed thereon. Between the two panes of glass 19 and 20, there can be observed part of a spacer 31, which includes a step at its upper end. This end serves as a stop for a spacer profile holder 21 of a mounting shield 18. The mounting shield 18 forms the lateral termination of the roller-blind housing (not shown). The mounting shield 18 includes a printed board 23 with electric line connections 13 for the passage of electric power therethrough. In assembled condition of the roller-blind device and the insulated panel, the printed board 23, together with the electric line connections 13, form an airtight lateral closure.

Figure 5:
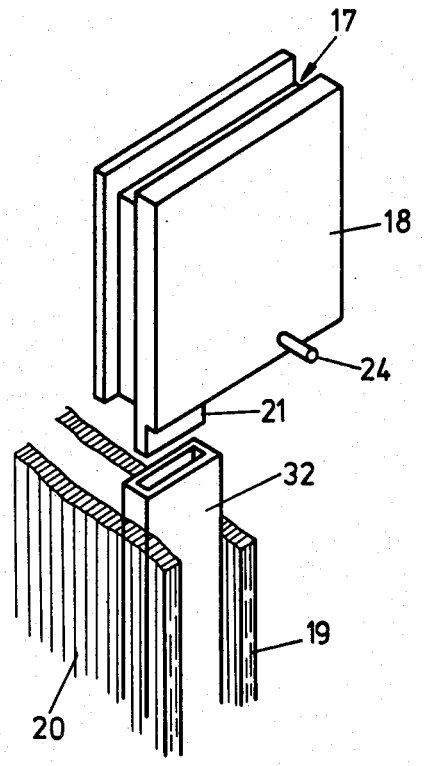

FIG. 5 shows a similar embodiment in a view similar to FIG. 4. In this case, the spacers 32 are constructed as closed hollow profiles. The spacer profile holder 21 of the mounting shield 18 is adapted, as can be noted, to complement the cross section of the spacer 32. The spacer 32 can have on its inside (not shown) an attached U-shaped profile which serves for guiding the curtain and prevents formation of a slit through which light can penetrate between the curtain and the spacer 32. In the case of the mounting shield 18, a corresponding groove 17 to receive a sealing composition is provided, as well as a valve 24 which makes it possible to evacuate the air from the airtight inner space.

The embodiments described below use an insulated panel which can be installed in an existing frame and is provided with a roller-blind device, for which purpose the insulated panel is to be adapted by design to the construction of the roller-blind.

Figure 7:
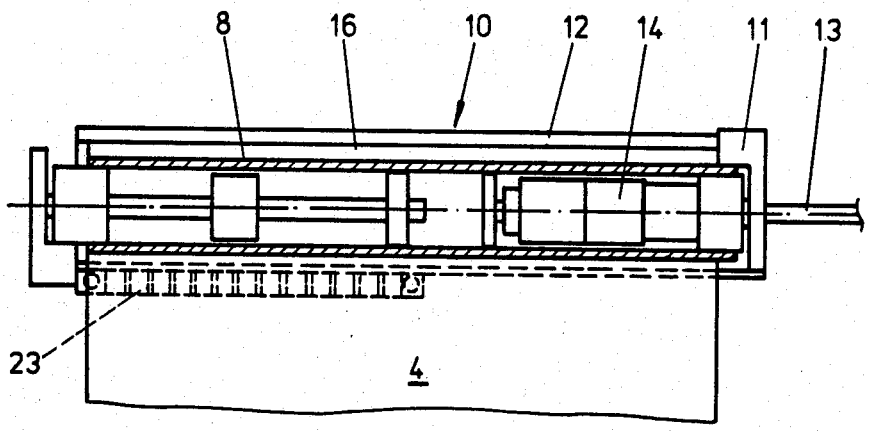
FIG. 7 is an elevational view of a roller-blind with electric drive motor arranged therein for installation in a housing for a roller-blind device which is intended for installation in an insulated panel for instance in accordance with FIG. 1.

In FIG. 7, the corresponding parts of the roller-blind device 10 are marked with the same reference numbers as used in FIG. 1. In connection herewith, it is a prerequisite that the housing 12 to be described is airtight and installable in an airtight manner in the insulated panel.

Figure 9:
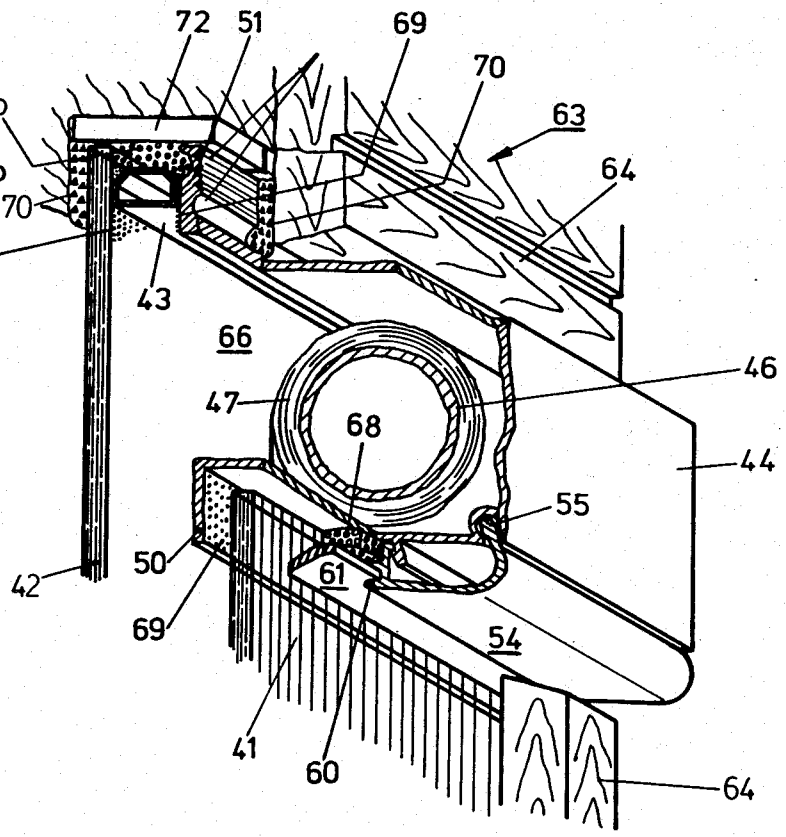
FIG. 9 is a perspective view of the embodiment of FIG. 8, with parts broken away.

In FIGS. 8 and 9, which show an important embodiment, there is illustrated an insulated panel 40 having an inner glass panel 41 and an outer pane of glass 42 installed as a structural unit in a window frame (only a part thereof which is shown). The two panes of glass 41 and 42 are spaced apart in the region of their periphery by means of spacer profile strips 43 such as available commercially, and are connected by the strips. The strips may comprise for instance, a butyl sealing composition 84*a* and 84*b*.

Also to be noted is a roller-blind housing 44 with a roller-blind 46 on which a foil 47 is wound. The free end of the foil 47 can be unwound into the space between the two panes of glass 41 and 42. The roller-blind 46 has a roller-blind turning shaft 49. The roller-blind housing 44 is provided with two holdings strips 50 and 51. The strip 50 provides a connection with the inner pane of glass 41, while the strip 51 serves to form, in part, the upper closure of the insulated panel.

The dashed line outer contour shows that this insulated panel with its roller-blind has even in its upper edge regions and despite the roller-blind, the normal dimensions of an insulated panel without a roller-blind and therefore it fits in standard window frames. One edge of the roller-blind housing 44 comprises a pivot-bearing shell 53 into which a bearing profile 55 of a swing strip 54 is inserted and held swingably and securely in the shell 53. A hooking profile 57 on the roller-blind housing 44 and one 58 on the swing strip 54 permits the holding of the strip 54 securely in its mounted end position. The other end of the swing strip 54 is shaped as a holding U-rail 60 and serves to receive an elastic holding or sealing strip 61. Upon the closing of the swing strip 54 the holding strip 61 comes to rest snugly against the inner pane of glass 41.

The insulated panel 41 with its roller-blind housing 44 placed thereon and the parts thereof described above has applied to its outside region sealing materials such as thiocol including seal portions 68*a* and 68*b* and butyl seals 69 or the like. In this way there is obtained a structural unit ready for installation and consisting of an insulated panel for a window with a roller-blind. This unit is inserted into the window frame 63, held securely with corresponding window rabbet strips 64 and then sealed, for instance, with silicone seals 70. The same purpose is served by so-called blockings which consist of short wedges 72 of wood or plastic. Depending on the length of the joint between the insulated panel and the window frame, a different number of wedges are placed into the joints. In this way, the insulated panel 40 with its roller-blind housing 44 and roller-blind 46, including its motor drive (similar to FIG. 7), is installed in an existing window frame 63. Accordingly, the space 66 between the panes of glass 41 and 42 and in the region of the roller-blind housing 44 is maintained in an airtight manner.

Figure 11:
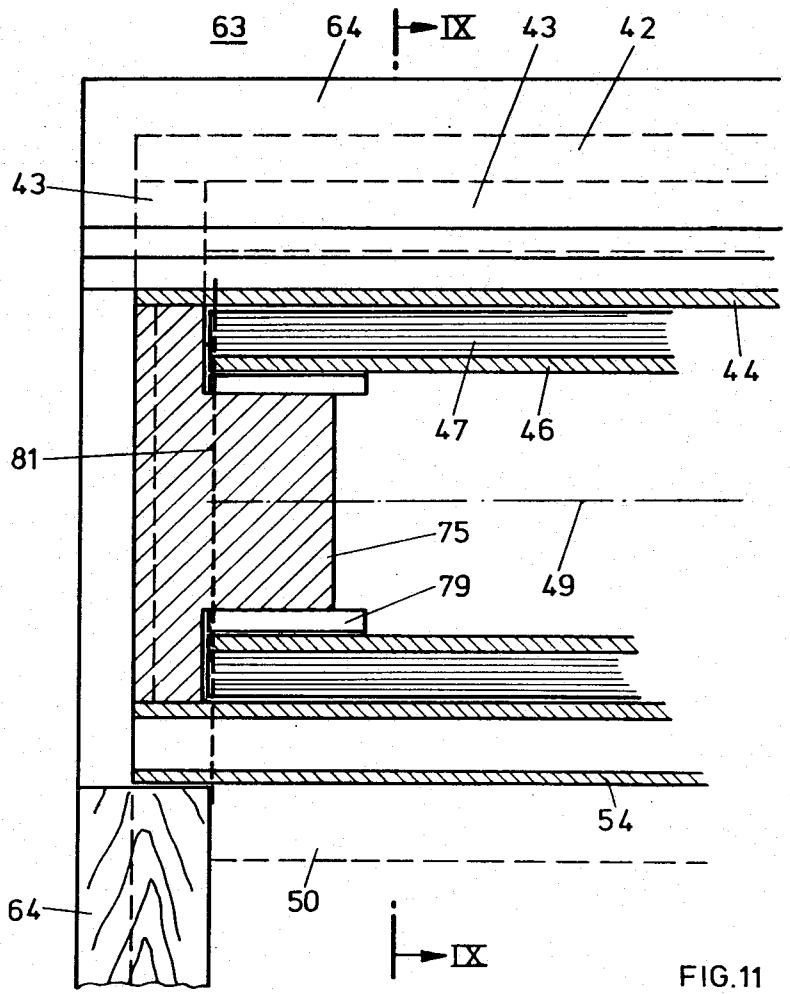
FIGS. 10 and 11 show another embodiment in a view similar to that of FIGS. 8 and 9.
Figure 10:
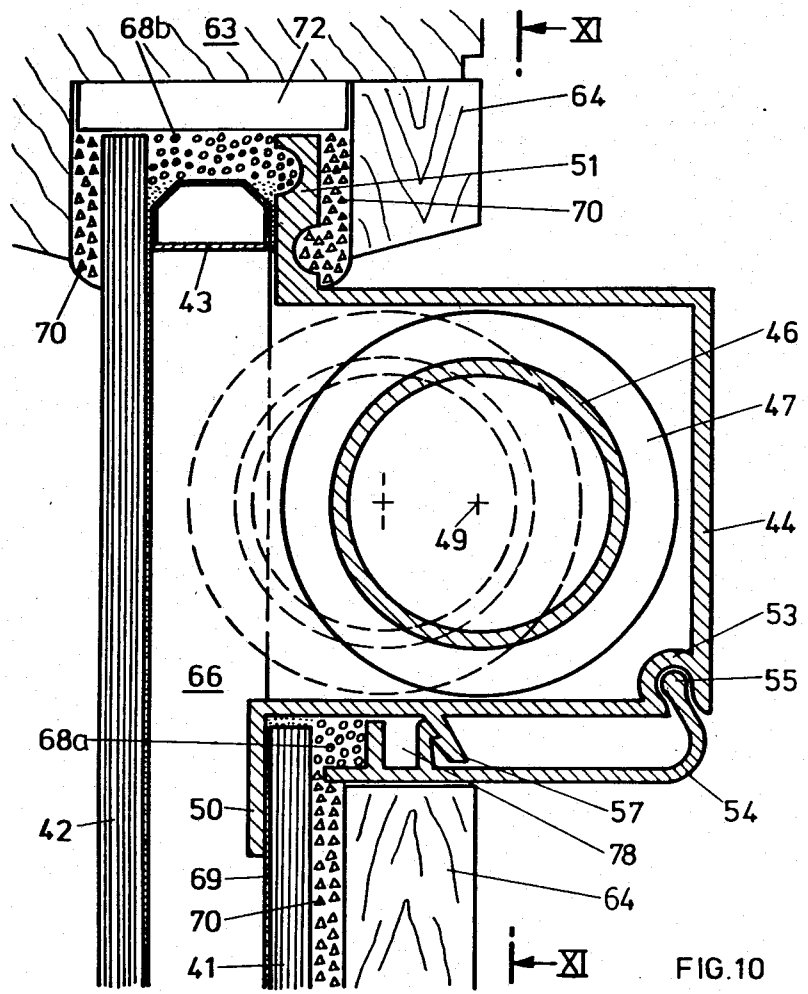

FIGS. 10 and 11 show a slightly modified embodiment which is similar to FIGS. 8 and 9 and, in which the pivot-bearing shell is shown with a somewhat differently shaped end portion. As in FIGS. 8 and 9, an end bearing shell 79 which is pushed over the mounting shield 75 and serves to receive the roller-blind 46 is also provided. Otherwise this embodiment, as the reference numbers indicate, corresponds to that of FIGS. 8 and 9.

Figure 12:
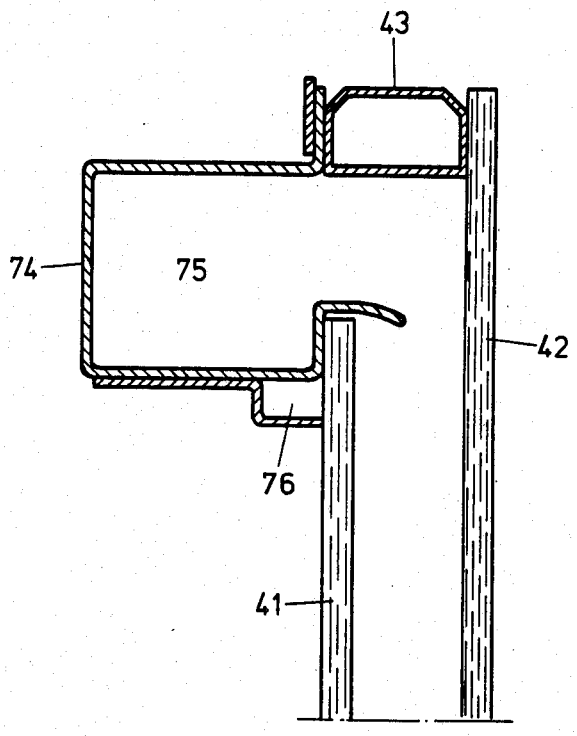
FIG. 12 is a cross section through another embodiment of a roller-blind housing.

If the roller-blind device of FIG. 11 is narrowed laterally to the dashed line 81 then the vertical glass rabbet strip 64 can be lengthened to the horizontal strip 64A. These strips then possibly form the edge of a rectangle or square which is closed on itself. FIG. 12 shows a somewhat modified cross-sectional shape of a roller-blind housing 74, having a mounting shield 75 and a corresponding groove 76 to receive a seal. Otherwise, the embodiment corresponds to that of the roller-blinds described and the insulation glazing.

The last few embodiments are extremely simple in design. An insulated panel is prepared so that it can receive a roller-blind device. It has an inner pane of glass 41 which is shortened in its upper part in order to receive a standard roller blind unit. The panel is adopted to be insertable into an existing frame. These structural parts are to be sealed off in an airtight manner from each other in the way which has been described, resulting in minimum usage of sealing strips and of labor. The invention produces a lasting airtight structure.

As a means for conditioning the environment within the interior space of the insulation panel to be resistant to gas diffusion therein, an appropriate product, such as special metal aluminosilicates or silica gel, for example, is introduced into the interior space. The product is introduced through an opening in the insulated panel that communicates with the interior space thereof. The opening can be in the housing 74 or in the side closure wall 18, for example. The opening is accessible from the outside and is capable of being sealed off. The opening permits replenishing of the product within the insulated panel once every several years.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A roller-blind device suitable for making an airtight connection to an insulated panel which includes first and second transparent panes, generally parallel to one another and spaced a predetermined distance from one another, the distance being primarily selected for optimizing the insulation properties of the insulated panel, the space between the panes defining and airtight interior volume accessible only through a longitudinally extending opening in the insulated panel, the roller-blind device comprising:

an elongated housing defining an interior space which is substantially greater, along any cross section through the interior space, than the predetermined distance of the insulated panel, the housing further including a sole opening located along one longitudinal side thereof, and means, located at the opening of the housing, for mounting the housing in an airtight manner to the insulated panel, the mounting means including first and second longitudinal strips which extend away from the housing and which are receivable within the interior volume of the insulated panel through the longitudinally extending opening in the panel, in a mated condition the interior volume of the panel and the interior space of the housing being in communication with another and impervious to gas diffusion into and out therefrom;

first and second side closure walls located at laterally opposite ends of the housing;

a roller rotatably mounted in the housing and extending between and supported on the side closure walls;

a blind attached to the roller and windable thereupon, the blind being movable into and substantially out of the interior space of the insulated panel;

a motor, located in the housing and coupled to the roller for rotating the roller; and actuating means, accessible exteriorly of the housing and of the insulated panel and coupled to the motor through the housing in an airtight manner, for actuating the motor.

2. The device of claim 1 in which the actuating means include electrical feed lines which are coupled to the motor and which emerge from the housing through an airtight passage defined therein.

3. The device of claim 2 further comprising sealant applied between the electrical feed lines and the housing to improve the airtightness therebetween.

4. The device of claims 1 or 2 in which the housing is defined by outer walls which include a thermal and acoustic layer.

5. The device of claims 1 or 2 in which each side closure wall is defined by a circumscribing peripheral edge and further including a respective groove defined in the peripheral edge of the first and second side closure walls, the housing, the insulated panel, and the side closure walls mating with one another in the area of the respective groove and providing an airtight connection therebetween.

6. The device of claim 5 in which the blind includes an edge portion extending along a longitudinal side thereof, the edge portion being adapted to be lowered or raised in the interior space of the insulated panel through rotation of the roller, the edge portion having a shape for sealingly separating the interior space of the insulated panel from the housing when the blind is in an uppermost raised position.

7. The device of claims 1 or 2 further comprising a support strip having a first end which is anchored against the insulated panel and a second end which abuts and supports the housing, the housing including a longitudinal profile extension which protrudes from the housing and abuts the support strip at a location thereof between the first and second ends.

8. The device of claim 1 in which the first transparent pane of the insulated panel is longer than the second pane and in which the first strip sealingly engages the second pane, the roller further including a spacer longitudinally extending along a peripheral edge of the first longer pane, the second strip of the housing being engagably coupled to the spacer whereby a substantially uniform spacing is maintained between the first and second panes of the insulated panel.

9. The device of claim 8 in which the first and second side closure walls include means for supporting the spacer therein.

10. The device of claims 1 or 2 in which the means for actuating the motor includes electronic means for producing pulses which rotate the motor in a first or second direction.

11. The device of claim 1 in which the predetermined distance associated with the insulated panel is not greater than about 15 mm.

12. A roller-blind and insulated panel combination, comprising:

an insulated panel defining an enclosed interior space, the insulated panel including first and second generally parallel transparent isulation panes which comprise main surfaces for the interior space and which are spaced at a predetermined distance from one another, the interior space being airtight and accessible only through a longitudinally extending opening in the insulated panel;

an elongate housing for defining an airtight interior space and having a sole opening located along one longitudinal side thereof, the opening in the housing being defined by first and second longitudinal strips which extend away from the housing and which are receivable within the interior space of the insulated panel through the longitudinally extending opening in the panel, the housing measuring, in any cross section, substantially more than the predetermined distance of the insulated panel the respective openings of the housing and of insulated panel mating with each other in an airtight fashion whereby the interior spaces of the insulated panel and the housing communicate, in an airtight manner, the housing being supported by the insulated panel and further having a lateral width which permits the insulated panel to be received and installed in standard sized window and door frames, the spacing between the main surfaces of the panel being of a size which is selected to optimize insulation properties of the insulated panel;

a roller rotatably mounted in the housing;

a blind attached to the roller and windable thereupon, the blind being movable into and substantially out of the interior space of the insulated panel;

a motor, located in the housing and coupled to the roller for rotating the roller; and actuating means, accessible exteriorly of the housing and of the insulated panel and coupled to the motor through the housing in an airtight manner, for actuating the motor.

13. The device of claim 12 in which the housing is formed with window rabbet strips along an upper region thereof, the window rabbet strips providing a mating surface which permits the insulated panel to engage a window or door frame therealong.

14. The device of claim 12 in which an outer upper width of the housing is about equal to an outer upper width of the insulated panel less about the width of the window rabbet strips in order to extend at least one of the lateral strips of the housing over the entire height of the insulated panel.

15. The device of claim 12 in which the housing and the first and second panes of the insulated panel together form a continuous airtight housing which define the interior spaces of the insulated panel and of the housing.

16. The device of claim 12 in which the interior space between the first and second panes of the insulated panel extends generally along one flat plane and in which the housing is dimensioned and shaped to protrude laterally and normally to the plane of the interior space and toward a first inwardly directed direction.

17. The device of claim 12 in which the first transparent pane of the insulated panel is longer than the second pane and in which the first strip sealingly engages the second pane, the insulated panel further including a spacer longitudinally extending along a peripheral edge of the first longer pane, the second strip of the housing being engageably coupled to the spacer whereby a substantially uniform spacing is maintained between the first and second panes of the insulated panel.

18. The device of claim 17 in which the spacing between the first and second panes of the insulated panel ranges between 8 and 15 millimeters.

19. The device of claim 17 in which a sealant is provided between the first strip and the second shorter pane to improve the sealing therebetween, the insulated panel further comprising a supporting strip having a first end which is anchored against the second insulated pane and a second end which abuts and supports the housing, the housing including a longitudinal profile extension which protrudes from the housing and abuts the support strip at a location thereof between the first and second ends.

20. The device of claim 17 in which the second strip and the first pane and the first strip and the second pane are sealed to one another, respectively, by butyl and thiocol.

21. The device of claim 12 in which a respective portion of the first and second strips is knurled to improve the sealability between the strips and the insulated panel.

22. The device of claim 12 in which the first and second strips are provided with grooves and in which the insulated panel is provided with complementary projections, the complementary projections fitting within 23. The device of claim 12, further including a sealable opening defined in the housing, the sealable opening having a sufficient size to permit the passage therethrough of an environment conditioning product into the housing.

24. The device of claim 23 in which the product comprises aluminosilicates.

25. The device of claim 23 in which the product is silica gel.

26. The combination of claim 12 in which the predetermined distance associated with the insulated panel is not greater than about 15 mm.

27. A transparent panel for obstructing an opening in a building, the panel comprising:

a frame having an outer periphery which is shaped to fit snugly in the opening in the building;

an insulated panel including first and second spaced transparent insulated panes, the volume between the panes defining an airtight inner space which is accessible only through a longitudinally extending opening in the panel, the spacing between the insulated panes being effective for optimizing insulation properties of the insulated panel;

an elongate housing defining an interior space and having an opening located along one longitudinal side thereof, the opening being defined by first and second longitudinal strips which extend away from the housing and are receivable within the interior space of the insulated panel, the respective openings of the housing and of the insulated panel mating with each other whereby the interior spaces of the insulated panel and the housing communicate, in an airtight manner, the housing being supported on the insulated panel and further having a lateral width which permits the insulated panel to be received and installed in window and door frames having standard sizes;

a roller rotatably mounted in the housing;

a blind attached to the roller and windable thereupon, the blind being movable into and substantially out of the interior space of the insulated panel;

a motor, located in the housing and coupled to the roller for rotating the roller; and actuating means, accessible exteriorly of the housing and of the insulated panel and coupled to the motor through the housing in an airtight manner, for actuating the motor.

* * * * *